United States Patent [19]

Dufau

[11] 4,312,556

[45] Jan. 26, 1982

[54] ELECTRICAL CONNECTOR

[76] Inventor: Oscar Dufau, 1420 Calle Grande, Fullerton, Calif. 92635

[21] Appl. No.: 136,526

[22] Filed: Apr. 2, 1980

Related U.S. Application Data

[63] Continuation of Ser. No. 914,893, Jun. 12, 1978, abandoned.

[51] Int. Cl.[3] ..... H01R 11/20

[52] U.S. Cl. ..... 339/99 R; 339/97 R

[58] Field of Search ..... 339/97 R, 97 C, 97 P, 339/98, 99 R

[56] References Cited

U.S. PATENT DOCUMENTS

| | | | |
|---|---|---|---|
| 2,534,881 | 12/1950 | Schroeder | 339/97 R |
| 2,702,895 | 2/1955 | Paulinetz | 339/97 C X |
| 3,821,691 | 6/1974 | Reimer | 339/97 R |
| 3,825,881 | 7/1974 | Wigby | 339/97 R |
| 3,829,822 | 8/1974 | Geiser et al. | 339/98 |
| 4,195,898 | 4/1980 | Chow et al. | 339/99 R |

FOREIGN PATENT DOCUMENTS

| | | | |
|---|---|---|---|
| 2520837 | 11/1975 | Fed. Rep. of Germany | 339/99 R |

*Primary Examiner*—Eugene F. Desmond

*Attorney, Agent, or Firm*—Christie, Parker & Hale

[57] ABSTRACT

An electrical connector having a contact providing combined strain relief and insulation piercing for an elongated insulated conductor. A spring metal contact member is elongated in a longitudinal direction and has a contact end and a portion wrapped longitudinally back over itself to form first and second overlapping contact member portions. The overlapping contact member portions are formed therebetween with at least one insulation cutter and at least one strain relief clamp. The strain relief clamp is spaced from and on the opposite side of the cutter from the contact end. A nonconductive housing defines a chamber therein for receipt of at least a portion of the overlapping contact member portions. The chamber has opposing sides spaced so that upon positioning the overlapping contact member portions therebetween, while an insulated conductor is positioned between the cutter and the strain relief clamp, the overlapping contact member portions are forced from an open to a relatively closer closed position thereby causing the strain relief clamp to clamp an insulated portion of such insulated conductor and thereby causing the cutter to displace the insulation and to engage the conductor of such insulated conductor.

8 Claims, 12 Drawing Figures

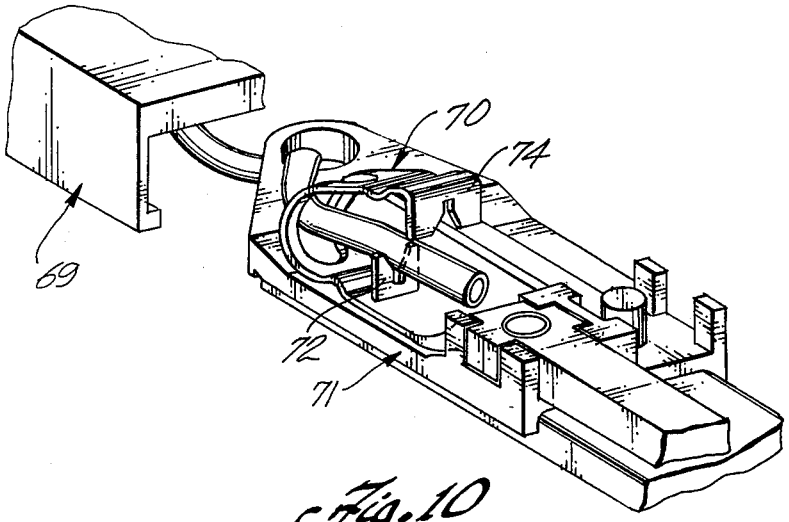
Fig. 10
Fig. 6
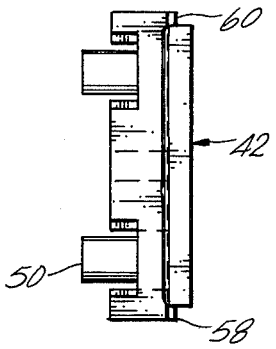
Fig. 8
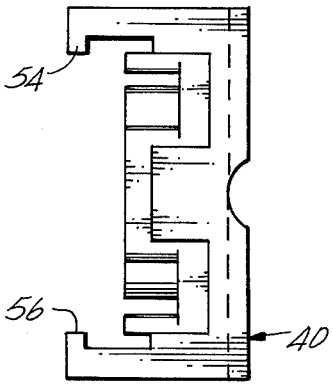

ELECTRICAL CONNECTOR

CROSS REFERENCE TO RELATED APPLICATIONS

This is a continuation of application Ser. No. 914,893, filed June 12, 1978, now abandoned.

BACKGROUND OF THE INVENTION

This invention relates to electrical connectors and more particularly to an electrical connector having combined strain relief and insulation piercing characteristics.

Circuit concentration bays have been developed by the telephone company to handle the increased demand for additional telephone services and thereby provide improved methods of telephone traffic distribution. An interconnection system has been developed for circuit concentration bays utilizing a back panel and patch cord plugs. One side of the back panel is used for wire wrapping while on the other side of the panel provision is made for plugging in a patch cord plug.

The patch cord plugs are made up of one or more male pins and very small wire, i.e., in the order of 24 or 26 gauge, is either soldered or crimped to the pins. After the pins are made and connected to the wire, two plastic insulator halves are positioned on opposite sides of the male pins and are bonded together using ultrasonic bonding techniques.

Although a tool is generally provided for removing patch cord plugs from the back panel, it is sometimes necessary to pull a patch cord plug out by the wires. For this and other reasons, strain relief for the wires is necessary to prevent their being pulled loose from the pins. Therefore the patch cord plug has a built in strain relief that removes all strain from the interconnection of the wire to the pin. This strain relief is provided by a pair of ridges which are an integral part of the two piece insulator forming the housing.

A disadvantage of the aforementioned arrangement is that special tools are required to clamp and/or solder the pins to the wires. Also, special tools are required to bond the two insulator halves together. Additionally, two steps are required to assemble each patch cord plug. One step is required to solder or fasten each wire to each contact and a second step is required to bond the insulator halves together. Since a great number of plugs are required in the circuit concentration bays, the labor involved in these steps may be staggering.

A further drawback to the aforementioned patch cord plug design is that the patch cord plug is not reusable. If, for example, it is desired to change the connection of the wires to the pins, it is necessary to cut the wires from the plug and provide a new plug which of course must be reassembled in the manner discussed above.

A further problem in the aforementioned patch cord plug design is that the pair of strain relief ridges are provided in the housing and cause a transverse load on the housing when force is applied to the wires. As a result, special precautions in the form of multiple posts are required to rigidly attach and bond the insulator halves together.

Other types of electrical connectors are known which have insulation displacing cutters but which require special tools for applying pressure to force the cutters to pierce the insulation on the insulated conductor. One class of such electrical connectors has insulation piercing and strain relief in transverse overlapping portions of the metal contact.

Electrical connectors are also known in which the insulated conductor has its insulation automatically pierced or displaced as a housing for the connector is closed. However, these devices are normally quite large and do not permit use in back panel and patch cord plugs of the type employed in circuit concentration bays of the sizes referred to above. Further, the contacts themselves do not provide strain relief for the insulated conductor, this function being provided by the housing.

SUMMARY OF THE INVENTION

Briefly, an electrical connector in accordance with the present invention has a contact providing combined strain relief and insulation piercing for an elongated insulated conductor. The connector comprises a spring metal contact member elongated in a longitudinal direction thereof and having a contact end and a portion wrapped longitudinally back over itself to form first and second overlapping contact member portions. The overlapping contact member portions are formed therebetween with at least one insulation cutter and at least one strain relief clamp. The strain relief clamp is spaced from and is on the opposite side of the cutter from the contact end.

A nonconductive housing defines a chamber therein for receipt of at least a portion of the overlapping contact member portions. The chamber has opposite sides spaced so that when positioning the overlapping contact member portions therebetween, while an insulated conductor is positioned between the cutter and the strain relief clamp, the overlapping contact member portions are forced from an open to a relatively closer closed position thereby causing the strain relief clamp to clamp an insulated portion of such insulated conductor and thereby causing the cutter to displace the insulation and to engage the conductor of such insulated conductor.

With such an arrangement the strain relief and insulation piercing are provided as an integral part of the spring metal contact and further allows the assembly of the spring metal contact member into the housing at the same time that an insulated conductor is pierced, connected and clamped to the spring metal contact member. Such an arrangement provides a number of advantages. By way of example, the overall dimensions of the electrical connector must be kept quite small. With the present invention this design requirement may be achieved while providing an electrical connector assembly which will pierce the insulated conductor and apply the strain relief clamping force simultaneously with the step of assembling the spring metal contact member into the housing. With such an arrangement it is now possible to provide a patch cord connector which is easily assembled in the field without the requirement of special tools and in a single step as opposed to the multiple step process required of the prior patch cord plug. Additionally it is now possible to provide an electrical connector in which force on the wires connected to the spring metal contact members does not apply transverse loading to the housing.

Preferably the overlapping contact member portions diverge toward the contact end. As a result, during assembly, the clamp being farther away from the contact end than the cutter will clamp the insulated wire and retain it during the insulation displacing step.

Preferably the spring metal contact member comprises a connecting portion between the first and second overlapping cutter member portions, having an opening therein which provides a path through which the insulated conductor extends to reach the cutter and strain relief clamp.

Additionally the strain relief clamp preferably comprises a ridge on the first overlapping portion in opposed relation to and extending toward the second overlapping portion so as to clamp the insulated conductor therebetween. Additionally there may be provided a further ridge on the second overlapping portion in opposed relation to and extending toward the first overlapping portion, the ridges being longitudinally offset from one another. With such an arrangement, force applied to the wire connected to the spring metal contact provides very little transverse force on the housing and as a result the housing can be constructed of a very thin plastic material as necessary for the small size requirement of patch cord plugs.

Preferably the cutter comprises at least one substantially V-shaped blade formed from one of the overlapping contact member portions. The other overlapping contact member portion cooperates with the blade, when the relatively closer closed position exists, so as to press the insulated conductor between the sides of the V-shaped blade until the insulation is displaced and the conductor is in engagement with at least one of the sides of the blade. Preferably a ridge is provided on the other overlapping contact member portion for forcing the insulated conductor between the sides of the V-shaped blade. In a preferred embodiment, two V-shaped blades are formed from the overlapping contact member portions.

According to a preferred embodiment of the invention the housing comprises first and second relatively slidable housing parts and means for affixing the spring metal contact member in a longitudinal direction on the first housing part. With this arrangement it is possible to position the spring metal contact member on one of the housing parts, position the insulated conductor between the overlapping contact member portions, slide the housing parts together and, in one step, cause the strain relief clamp and cutter to, respectively, clamp the insulation and displace the insulation on the insulated conductor.

Since the spring metal contact is resilient it is possible to remove the spring metal contact from the housing, allowing the spring metal contact member, due to its resiliency, to open and allow removal of the insulated conductor. A different insulated conductor can then be placed between the overlapping portions of the spring metal contact member and the spring metal contact member repositioned in the housing.

BRIEF DESCRIPTION OF THE DRAWINGS

FIG. 6 is an end elevation view of the lower insulator housing of FIG. 4;

FIG. 8 is an end elevation view of the lid of FIG. 7;

FIG. 10 is an enlarged perspective view partially broken away of an alternate connector and embodying the present invention;

DESCRIPTION OF THE PREFERRED EMBODIMENTS

Figure 3:
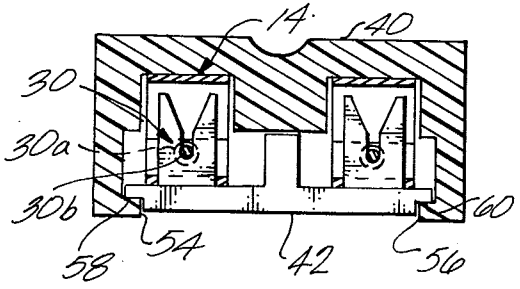
FIG. 3 is a cross-sectional view of the connector of FIG. 2 taken along the lines 3—3 with the second metal spring contact and a pierced insulated conductor in place.

FIGS. 1–9 illustrate an electrical connector having a contact providing combined strain relief and insulation piercing for an elongated insulated conductor which is constructed in accordance with one embodiment of the present invention.

The electrical connector includes two spring metal contact members only one being shown at 10.

The spring metal contact member 10, extending transverse to the longitudinal direction of the contact member, has a contact end 12 adapted for connection with another contact. Preferably the contact end 12 is an elongated male contact preferably rectangular in cross-section for mating with a receptacle as is conventional in the patch cord art. Significantly the spring metal contact member is longitudinally wrapped back over itself to form first and second overlapping contact member portions 14 and 16. The overlapping contact member portions 14 and 16 are formed therebetween with at least one insulation cutter and at least one strain relief clamp. To this end, a strain relief clamp 18 is spaced a short distance from and on the opposite side of a cutter 20 from the contact end 12.

A nonconductive or insulator housing 22 has a chamber 24 (FIG. 2) therein for receipt of at least a portion of the overlapping contact member portions. The chamber 24 has opposing sides 26 and 28 spaced so that upon positioning the overlapping contact member portions between the opposing sides 26 and 28, while an insulated conductor is positioned between the cutter and strain relief clamp, the overlapping contact member portions 14 and 16 are forced from an open to a relatively closer closed position, causing the clamp portion 18 to grip and clamp the insulated portion of the insulated conductor and causing the cutter 20 to displace the insulation and to engage the conductor of the insulated conductor.

Figure 1:
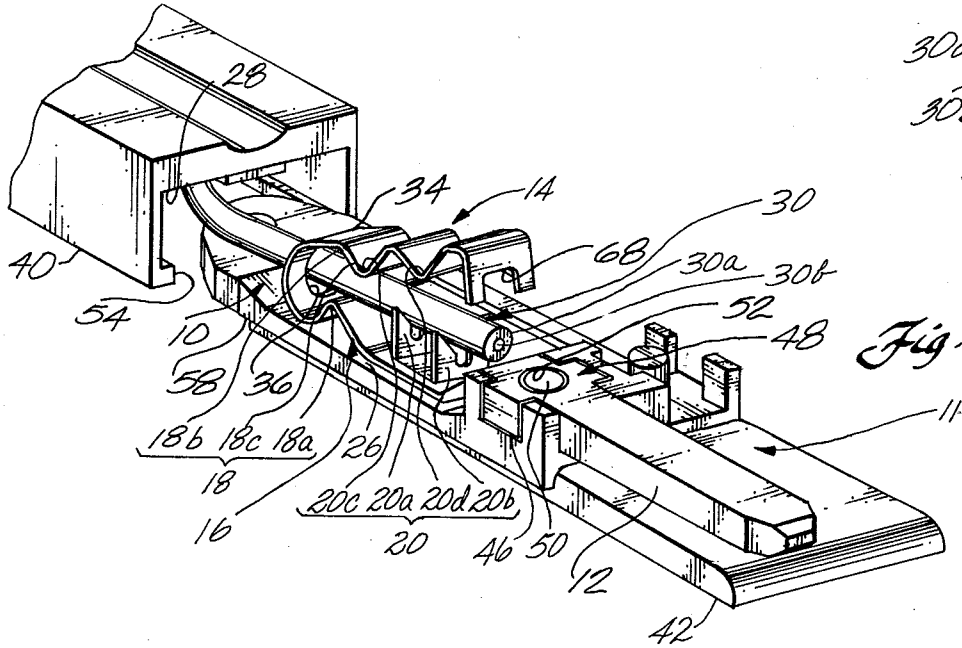
FIG. 1 is an enlarged perspective view of an electrical connector before assembly and constructed in accordance with the present invention; a portion of the upper housing part is broken away from simplicity.
Figure 2:
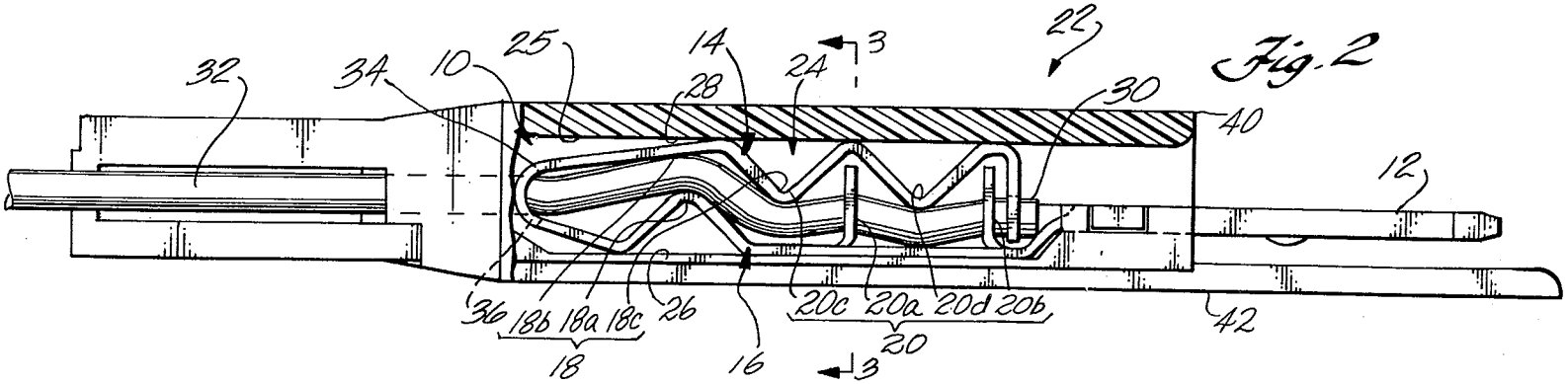
FIG. 2 is a side elevation view of the electrical connector of FIG. 1 with a portion of the upper housing part broken away to reveal the interior of the housing.
Figure 4:
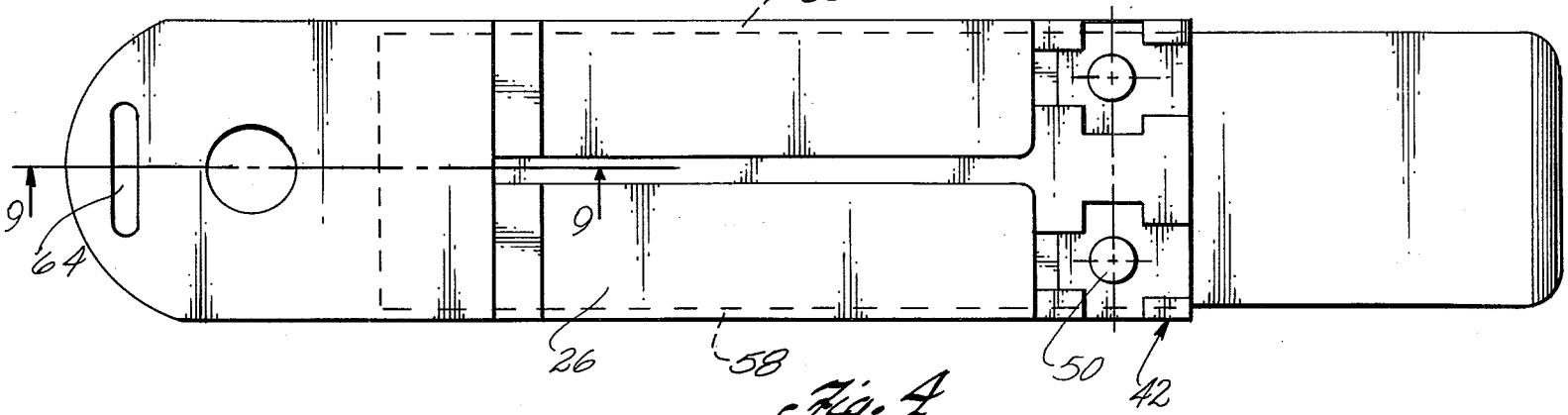
FIG. 4 is a top elevation view of the lower insulator housing for the connector of FIG. 1.
Figure 5:
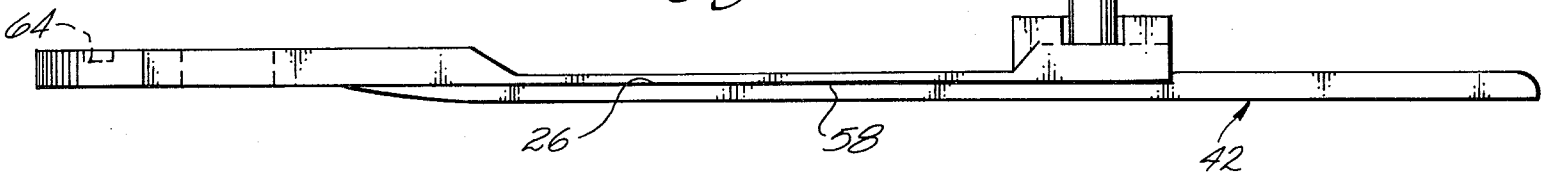
FIG. 5 is a side elevation view of the lower insulator housing of FIG. 4.
Figure 7:
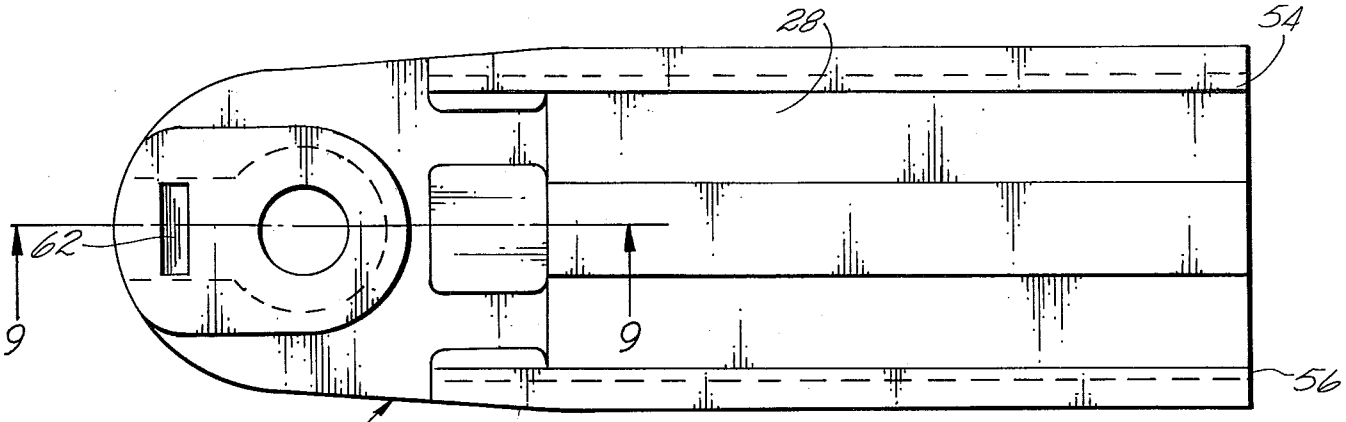
FIG. 7 is an elevation view of the lid forming the upper insulator housing for the connector of FIG. 1.

By way of example, an insulated conductor 30, having insulation **30*a* surrounding a conductor 30*b*, extends between the overlapping contact member portions 14 and 16. The conductor 30*b* may be single or multiple strand wire. FIG. 1 shows the overlapping contact member portions in open position before being positioned between the opposing walls, whereas FIGS. 2 and 3 show the overlapping contact member portions 14 and 16 in the closed position after being positioned between the opposed sides 26 and 28**.

To be explained in more detail, the aforegoing construction is significant in that no crimping or wiring tools are required to connect an insulated conductor to the spring metal contact. Further, the strain relief and insulation displacing actions are achieved in a single step as the overlapping contact member portions of the spring metal contact member are being relatively positioned between the opposing sides 26 and 28 of the housing.

The spring metal contact member is preferably of a resilient material such as a phosphor bronze alloy having 85,000 to 99,000 pounds per square inch tensile strength which allows it to be used for clamping and displacing insulation on an insulated conductor and then re-opened, allowing the overlapping contact member portions to spring back to an open position and be reconnected to the same or another insulated conductor.

Preferably the spring metal contact member includes a resilient connecting portion 34 connected between the overlapping contact member portions 14 and 16. The connecting portion has an opening 36 therethrough which provides a path through which the insulated conductor 30 extends to reach the cutter and strain relief clamp. The connecting portion 34 assists in providing a spring action for the overlapping contact member portions and provides the opening 36 which cooperates with the clamp 18 in the manner to be described in more detail in relieving substantially all strain from the cutter 20 that may be applied at the free end 32 of the insulated conductor.

The strain relief clamp 18 includes a ridge 18*a*, extending transverse to the longitudinal direction of the contact member, on the overlapping portion 16. The ridge 18*a* extends toward the surface 18*b* on the upper overlapping portion 14. In the open position depicted in FIG. 1 the insulated conductor 30 in a virtually undeformed condition is positioned between the ridge 18*a* and the surface 18*b*. After the overlapping portions of the contact member are closed, the ridge 18*a* and surface 18*b* squeeze the insulated conductor and as a result cooperate with the opening 36 so as to remove any stress due to the insulated conductor from the cutter 20.

A further ridge 18*c* is provided on the upper overlapping portion 14 and also forms a part of the strain relief clamp. The ridge 18*c* extends toward the lower overlapping portion 16 and is longitudinally offset from the ridge 18*a* so that it is closer to the cutter 20. As a result the insulated conductor 30 is bent into a slightly "S" configuration, assisting in the strain relief function. It should further be noted that both of the ridges 18*a* and 18*c* are spaced from the opposite overlapping contact member portion even when the overlapping contact member portions are closed. This enables the strain relief clamp 18 to provide a firm gripping action on the insulated conductor without displacing the insulation.

The cutter 20 is preferably formed of one or more substantially "V" shaped cutter blades. To this end the lower overlapping portion 16 includes a "V" shaped cutter blade 20*a* stamped and bent from the lower overlapping contact member portion 16. A similar substantially "V" shaped cutter blade 20*b* is spaced from the "V" shaped cutter blade 20*a* and is stamped and bent from the same overlapping contact member portion 16. In addition the cutter 20 includes ridges 20*c* and 20*d* located in the upper overlapping contact member portion 14 which extend in the direction of the lower overlapping portion 16 so that when the overlapping portions are positioned to the closed position depicted in FIG. 2, the insulated conductor 30 is pressed between the sides of the "V" shaped cutter blades until the insulation thereof is displaced and the conductor thereof is in engagement with at least one side, preferably both sides, of both of the "V" shaped cutter blades 20*a* and 20*b*. Ridge 20*c* is the same as ridge 18*c* but is also labeled 20*c* to indicate that it also forms a part of the cutter 20.

FIG. 3 depicts the condition of the conductor after the insulation 30*a* has been displaced, allowing the conductor 30*b* to be wedged between the diverging sides of the "V" shaped blades. Significantly, the ridges 20*c* and 20*d* extend vertically downward, as depicted in FIG. 2, into the openings of the "V" shaped blades sufficiently so that the insulated conductor is forced downward between the "V" shaped blades until the insulation 30*a* is completely displaced and the conductor 30*b* is actually cut by both of the opposite diverging sides of both of the "V" shaped cutter blades.

Consider now the construction of the housing 22. The housing 22 in the embodiment being described is formed of first and second relatively slidable housing parts. To this end an upper housing part 40 forms a lid and slides onto lower housing part 42.

The lower housing part 42 includes means for mounting the spring metal contact in the housing. To this end a cross-shaped recess 46 in the lower housing part 42 mates with a cross-shaped portion 48 of the spring metal contact member 10. In addition a cylindrical-shaped extension 50 of the insulator housing extends through an opening 52 extending clear through the spring metal contact member 10. This arrangement secures and fixes the spring metal contact member 10 in the housing in a longitudinal direction of the spring metal contact.

The upper housing part 40 is generally U-shaped in cross-section. The upper and lower housing parts 40 and 42 include a slidable joint therebetween arranged so as to prevent movement apart of the opposed walls 26 and 28 due to pressure therebetween due to the spring action of the overlapping contact member portions of the spring metal contact. The slidable joint allows the upper and lower housing parts 40 and 42 to be slid together and in the same action causes the overlapping contact member portions to be forced relatively closer together to the closed position and thereby clamp the insulated conductor and displace the insulation on the insulated conductor in the manner described above.

The slidable joint includes a pair of parallel elongated projections 54 and 56 in the upper housing part 40 and downwardly facing parallel surfaces 58 and 60 in the lower housing part 42 which form a sliding connection.

Figure 9:
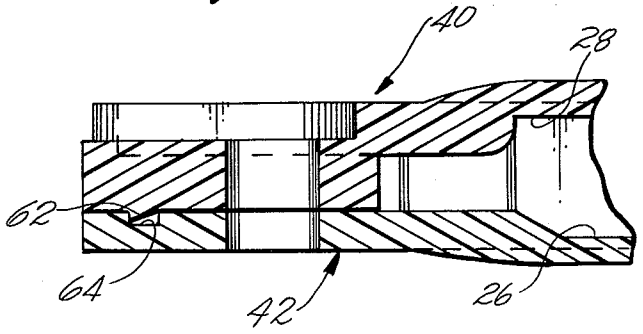
FIG. 9 is a longitudinal cross-sectional view of the rear portion of the upper and lower insulator housings of FIGS. 4 and 7 after assembly illustrating the detent interlock; the section is taken along the lines 9—9 of FIGS. 4 and 7.

A detent lock is provided between the upper and lower housing parts. As best seen in FIG. 9, a wedge-shaped projection 62 is provided on the upper housing part and a groove 64 is provided on the lower housing part. The projection 62 snaps into the groove 64 when the parts 62 and 64 are aligned, thereby locking the housing parts together in a longitudinal direction.

Consider briefly the operation of the electrical connector during the steps of clamping and displacing insulation on an insulated conductor.

Initially the spring metal contact member 10 is placed in position, as depicted in FIG. 1, in the mounting means including cross-shaped recess 46 and cylindrical-shaped extension 50, thereby securing the spring metal contact member against longitudinal or transverse movement in the lower housing. At this point the upper and lower overlapping contact member portions are generally diverging apart in their open position. Subsequently an insulated conductor such as conductor 30 is positioned in place between the overlapping contact member portions 14 and 16. In this regard the insulated conductor is slid through the opening 36 and then between the opposite sides of the clamp 18 and the insulation cutter 20. At this point the overlapping contact member portions 14 and 16 are positioned apart to the open position depicted in FIG. 1. Subsequently the upper housing part 40 is positioned with respect to the lower housing part 42 until the projections 54 and 56 engage the surfaces 58 and 60. The upper and lower housing parts are then slid relative to each other, causing the opposed sides 26 and 28 to force the diverging overlapping contact member portions toward each other until, first, the clamp clamps the insulated portion of the insulated conductor between the ridge 18*a* and the opposite surface 18*b* and, second, the ridges 20*c* and 20*d* cause the cutter blades 20*a* and 20*b* to displace the insulation and engage the conductor in the insulated conductor as depicted in FIGS. 2 and 3.

With the diverging angles between the overlapping contact member portions and the clamp displaced longitudinally away from the contact end 12 from the cutter, the clamp is caused to first firmly grip the insulated conductor and as a result the insulated conductor itself can be used as an aid in drawing the lid onto the lower housing part and causing the cutter to displace the insulation.

The spring metal contact member of FIGS. 1–2 includes a guide 68 for the insulated conductor 30. The guide aids in positioning the insulated conductor in place between the strain relief clamp and cutter.

Although one spring metal contact is depicted at 10 in FIG. 1 it will be understood that a second one identical to 10 is to be positioned at space 11. The invention is not limited to any particular number of spring metal contacts but includes one or any number more than one.

The foregoing construction is important in a number of respects. In this regard it is possible to make a housing for the electrical connector in which the overall transverse vertical thickness of the housing is in the order of 0.196 inches. In order to achieve such small dimension it is necessary to minimize the forces applied in a vertical direction. This has been achieved by the arrangement of the spring metal contact member in that a force on the insulated conductor causes longitudinal force on the spring metal contact but negligible transverse vertical forces on the spring metal contact and hence on the housing. In a preferred embodiment of the invention the overall length of the assembled electrical connector depicted in FIG. 2 is 1.616 inches and the width is 0.395 inches.

FIG. 10 depicts an alternate embodiment of the invention employing two slidable housing parts 69 and 71 and a spring metal contact member 70 similar to the one described hereinabove with respect to FIGS. 1–3. However, in contrast, one V-shaped cutter blade 72 is formed from the lower overlapping contact member portion whereas a second V-shaped cutter blade 74 is formed from the upper overlapping contact member portion. The embodiment of the invention depicted in FIG. 10 does not include the guide which is contained in the embodiment of FIGS. 1–3.

Figure 11:
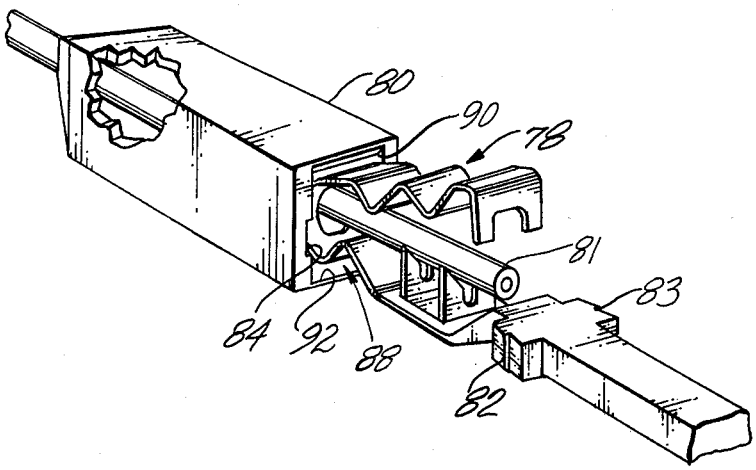
FIG. 11 is an enlarged perspective view partially in cross-section of an alternate connector before assembly and embodying the present invention.
Figure 12:
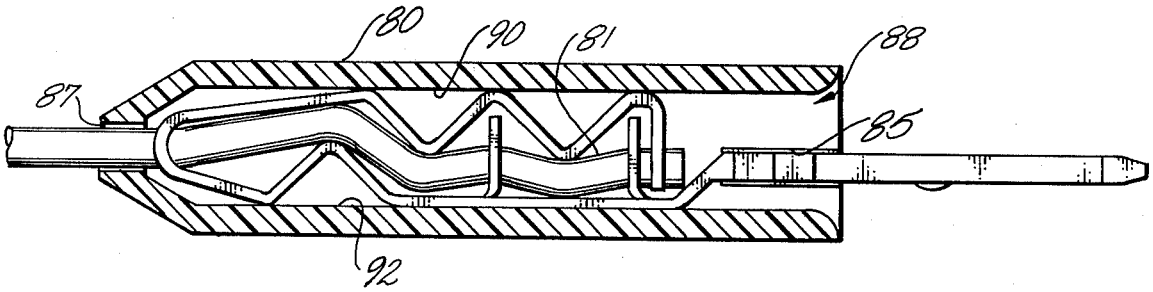
FIG. 12 is a side elevation view of the connector of FIG. 11 after assembly, showing the housing broken away to reveal the spring metal contact member and embodying the present invention.

FIGS. 11 and 12 depict an alternate embodiment of the invention in which a spring metal contact member 78 is slid into a unitary nonconductive housing 80 as opposed to the embodiment of FIGS. 1–3 and 10 where the housing is made of two slidable housing parts.

The housing 80, similar to housing 22, has opposed sides 90 and 92 for engaging and closing overlapping contact member portions of a spring metal contact member 78. The spring metal contact member 78 is substantially the same as the spring metal contact member 10 of FIGS. 1–3 except that the T-shaped portion of the spring metal contact has a pair of oppositely facing spurs 82 and 83 which slide into a pair of aligned and oppositely facing grooves 84 (see FIG. 11) and 85 (see FIG. 12) in the housing 80. The spurs 82 and 83 engage the oppositely facing sides of the grooves 84 and 85 and are dimensioned so that they are slightly larger than the spacing between the oppositely facing sides of the grooves 84 and 85, thereby retaining the spring metal contact member 78 therein once it is inserted in the housing 80.

The operation of assembling the spring metal contact 78 into the housing 80 is as follows. Initially an insulated conductor 81 is positioned between the clamp and insulation cutter in the manner described with reference to FIGS. 1–3. Subsequently the spring metal contact member 78 is positioned into the opening 88 of the housing 80. The upper and lower surfaces 90 and 92 engage the diverging upper and lower overlapping portions of the spring metal contact member 78 first causing the clamp to clamp the insulation on the insulated conductor as described above. Further movement of the upper and lower overlapping contact member portions into the housing 80 may now be assisted by pulling the end of the insulated conductor 81 extending out of a rear opening 87 of the housing 80. The upper and lower surfaces 90 and 92 of the housing 80 are dimensioned (as described hereinabove for the opposed surfaces 26 and 28 of the embodiment of FIGS. 1–3) so that as the overlapping contact member portions are drawn completely into the housing and the clamp clamps the insulated portion of the insulated conductor, the insulation cutter displaces the insulation and engages the conductor in the insulated conductor. The final position of the spring metal contact member is depicted in the cross-sectional view of FIG. 12.

Although an exemplary embodiment of the invention has been disclosed for purposes of illustration, it will be understood that various changes, modifications and substitutions may be incorporated into such embodiment without departing from the spirit of the invention as defined by the claims appearing hereinafter.

What is claimed:

1. An electrical connector having a contact providing combined strain relief and insulation piercing for an elongated insulated conductor, the connector comprising:

a spring metal contact member elongated in a longitudinal direction thereof and having a contact end and a portion wrapped longitudinally back over itself to form first and second overlapping contact member portions, the overlapping contact member portions being formed therebetween with at least one insulation cutter and at least one strain relief clamp, the strain relief clamp being spaced from and on the opposite side of the cutter from the contact end; and a nonconductive housing defining a chamber therein for receipt of at least a portion of the overlapping contact member portions, the chamber having opposing sides spaced so that upon positioning the overlapping contact member portions therebetween, while an insulated conductor is positioned between the cutter and the strain relief clamp, the overlapping contact member portions are forced from an open to a relatively closer closed position thereby causing the strain relief clamp to clamp an insulated portion of such insulated conductor and thereby causing the cutter to displace the insulation and to engage the conductor of such insulated conductor, the housing comprising first and second relatively slidable housing parts and means for affixing the spring metal contact in a longitudinal direction on the first housing part.

2. An electrical connector according to claim 1 wherein the first housing part comprises one of the opposing housing sides and the other housing part comprises the other opposing housing side.

3. An electrical connector having a contact providing combined strain relief and insulation piercing for an elongated insulated conductor, the connector comprising:

a spring metal contact member elongated in a longitudinal direction thereof and having a contact end and a portion wrapped longitudinally back over itself to form first and second overlapping contact member portions, the overlapping contact member portions being formed therebetween with at least one insulation cutter and at least one strain relief clamp, the strain relief clamp being spaced from and on the opposite side of the cutter from the contact end; and a nonconductive housing defining a chamber therein for receipt of at least a portion of the overlapping contact member portions, the chamber having opposing sides spaced so that upon positioning the overlapping contact member portions therebetween, while an insulated conductor is positioned between the cutter and the strain relief clamp, the overlapping contact member portions are forced from an open to a relatively closer closed position thereby causing the strain relief clamp to clamp an insulated portion of such insulated conductor and thereby causing the cutter to displace the insulationa first of said opposing sides for engaging the one of the overlapping contact member portions and a second housing part having a second of said opposing sides for engaging the other one of the overlapping contact member portions;

the first and second housing parts comprising a slidable joint therebetween arranged so as to prevent movement apart of the first and second opposed walls from pressure therebetween due to the spring action of the overlapping contact member portions of the spring metal contact.

4. An electrical connector according to claim 3 wherein the first and second housing parts comprise detent locking means therebetween for locking the housing parts in a longitudinal direction of the spring metal contact.

5. An electrical connector having a contact providing combined strain relief and insulation displacing for an elongated insulated conductor, the connector comprising:

a metal contact member elongated in the longitudinal direction thereof and comprising at opposite ends a contact portion and a portion having a thin dimension, the portion having the thin dimension being longitudinally wrapped back over the thin dimension thereof to form first and second overlapping thin contact member portions having a thin resilient portion connecting the overlapping portions together and urging them apart;

the overlapping thin contact member portions forming therebetween, when in a closed condition, at least one insulation cutter for displacing the insulation on such an insulated conductor and at least one strain relief clamp for clamping the insulation on such an insulated conductor without displacing the same from such conductor, the strain relief clamp being located at a position between the cutter and the thin resilient connecting portion;

the thin resilient connecting portion comprising an opening therethrough providing a path through which such an insulated conductor may extend to the strain relief clamp and the cutter; and a nonconductive housing for defining a chamber therein for receipt of at least a portion of the overlapping contact member portions, the chamber having opposing sides spaced so that upon positioning the overlapping contact member portions therebetween, while an insulated conductor is positioned between the cutter and the strain relief clamp, the overlapping contact member portions are forced from an open to a relatively closer closed position thereby causing the strain relief clamp to first clamp the insulation of such insulated conductor and subsequently cause the cutter to displace the insulation from such insulated conductor and to engage such conductor, the housing comprising first and second relatively slidable housing parts and means for fixing the spring metal contact in a longitudinal direction on the first housing part.

6. An electrical connector according to claim 5 wherein the first housing part comprises one of the opposing housing sides and the other housing part comprises the other opposing housing side.

7. An electrical connector having a contact providing combined strain relief and insulation displacing for an elongated insulated conductor, the connector comprising:

a metal contact member elongated in the longitudinal direction thereof and comprising at opposite ends a contact portion and a portion having a thin dimension, the portion having the thin dimension being longitudinally wrapped back over the thin dimension thereof to form first and second overlapping thin contact member portions having a thin resilient portion connecting the overlapping portions together and urging them apart;

the overlapping thin contact member portions forming therebetween, when in a closed condition, at least one insulation cutter for displacing the insulation on such an insulated conductor and at least one strain relief clamp for clamping the insulation on such an insulated conductor without displacing the same from such conductor, the strain relief clamp being located at a position between the cutter and the thin resilient connecting portion;

the thin resilient connecting portion comprising an opening therethrough providing a path through which such an insulated conductor may extend to the strain relief clamp and the cutter; and a nonconductive housing for defining a chamber therein for receipt of at least a portion of the overlapping contact member portions, the chamber having opposing sides spaced so that upon positioning the overlapping contact member portions therebetween, while an insulated conductor is positioned between the cutter and the strain relief clamp, the overlapping contact member portions are forced from an open to a relatively closer closed position thereby causing the strain relief clamp to first clamp the insulation of such insulated conductor and subsequently cause the cutter to displace the insulation from such insulated conductor and to engage such conductor, the housing comprising a first housing part having a first of said opposing sides for engaging one of the overlapping contact member portions and a second housing part having a second of said opposing sides for engaging the other one of the overlapping contact member portions, the first and second housing parts comprising a slidable joint therebetween and arranged so as to prevent movement apart of the first and second opposed walls from the pressure therebetween due to the spring action of the overlapping contact member portions of the spring metal contact.

8. An electrical connector according to claim 7 wherein the first and second housing parts comprise detent locking means therebetween for locking the housing parts in a longitudinal direction of the spring metal contact.

* * * * *

UNITED STATES PATENT AND TRADEMARK OFFICE

CERTIFICATE OF CORRECTION

PATENT NO. : 4,312,556

DATED : January 26, 1982

INVENTOR(S) : Oscar Dufau

It is certified that error appears in the above—identified patent and that said Letters Patent is hereby corrected as shown below:

Column 3, line 61, "from" should be -- for --;
column 5, line 1, after "in" insert -- the --;
column 9, line 44, "insulationa" should be -- insulation --
line 44, after "insulation" insert
-- and to engage the conductor of such insulated conductor;
the housing comprising a first housing part
having a --.

On the title page insert Item [73] Assignee:

Dynatech Corp, a Delaware corporation, of
Santa Ana, California 92702.

Signed and Sealed this

*Thirteenth* Day of *July 1982*

[SEAL]

*Attest:*

GERALD J. MOSSINGHOFF

*Attesting Officer*

*Commissioner of Patents and Trademarks*